US006192908B1

(12) United States Patent
Smith

(10) Patent No.: US 6,192,908 B1
(45) Date of Patent: Feb. 27, 2001

(54) PORTABLE CANE SEAT

(76) Inventor: William M. Smith, 477 S. Church St., Bowling Green, OH (US) 43402

( * ) Notice: Subject to any disclaimer, the term of this patent is extended or adjusted under 35 U.S.C. 154(b) by 0 days.

(21) Appl. No.: 09/373,119

(22) Filed: Aug. 12, 1999

(51) Int. Cl.[7] ..... A45B 3/00; A45B 5/00

(52) U.S. Cl. ..... 135/66; 135/65; 248/155; 248/155.2

(58) Field of Search ..... 135/66, 65; 297/3; 248/155, 155.1, 155.2

(56) References Cited

U.S. PATENT DOCUMENTS

| | | | | |
|---|---|---|---|---|
| 96,848 | * | 11/1869 | Sweeney | 135/66 X |
| 194,484 | * | 8/1877 | Truesdell | 135/66 X |
| 268,897 | * | 12/1882 | Houston | 135/66 X |
| 345,852 | * | 7/1886 | Leermo | 135/66 X |
| 389,810 | * | 9/1888 | Hendrickson | 135/66 X |
| 391,901 | * | 10/1888 | Leisner | 135/66 X |
| 436,176 | * | 9/1890 | Hendrickson | 135/66 X |
| 444,621 | * | 1/1891 | Schneider | 135/66 X |
| 478,460 | * | 7/1892 | Potter | 135/66 X |
| 484,334 | * | 10/1892 | More | 135/66 X |
| 490,416 | * | 1/1893 | Sutton et al. | 135/66 X |
| 493,285 | * | 3/1893 | Nixon | 135/66 X |
| 497,617 | * | 5/1893 | Ward | 135/66 X |
| 542,609 | * | 7/1895 | Gordon et al. | 135/66 X |
| 636,074 | * | 10/1899 | Skoog | 135/66 X |
| 645,527 | * | 3/1900 | Latourell et al. | 248/155 X |
| 763,166 | * | 6/1904 | Dougherty | 135/66 X |
| 767,245 | * | 8/1904 | Rogers | 135/66 X |
| 767,246 | * | 8/1904 | Rogers | 135/66 X |
| 771,165 | * | 9/1904 | Manderson et al. | 135/66 X |
| 779,449 | * | 1/1905 | Wagner | 135/66 X |
| 952,335 | * | 3/1910 | Killian | 135/66 X |
| 954,473 | * | 4/1910 | Schocke | 135/66 X |
| 1,089,295 | * | 3/1914 | Vallier | 135/66 X |
| 1,157,604 | * | 10/1915 | Vernet | 135/66 X |
| 3,987,807 | * | 10/1976 | Varnell | 135/66 |
| 4,062,372 | * | 12/1977 | Slusher | 135/66 |
| 5,755,245 | * | 5/1998 | Van Helvoort | 135/66 X |

FOREIGN PATENT DOCUMENTS

| | | | | |
|---|---|---|---|---|
| 36009 | * | 1/1906 | (CH) | 248/155 |
| 48165 | * | 3/1910 | (CH) | 248/155.2 |
| 63925 | * | 8/1892 | (DE) | 248/155.2 |
| 165912 | * | 12/1905 | (DE) | 248/155.2 |
| 2272637 | * | 5/1994 | (GB) | 135/66 |
| 28829 | * | 6/1918 | (NO) | 135/66 |

* cited by examiner

*Primary Examiner*—Peter M. Cuomo
*Assistant Examiner*—Rodney B. White
(74) *Attorney, Agent, or Firm*—John D. Gugliotta

(57) ABSTRACT

A combined seat and cane device comprised of a hollow tube with a handle pivotally connected at a top end, and a plurality of four seat support members with an attached fabric seat is removably inserted in a cavity at the top end in a manner to be deployed as required for forming a seat framework. At a lower end of the combined seat and cane device is a quadraped leg assembly that folds out and locks. The combined seat and cane device is easy to carry and caters to an individual's needs.

11 Claims, 6 Drawing Sheets

PORTABLE CANE SEAT

RELATED APPLICATIONS

The present invention was first described in Disclosure Document Number 451113 filed on Feb. 8, 1999. There are no previously filed, nor currently any co-pending applications, anywhere in the world.

BACKGROUND OF THE INVENTION

1. Field of the Invention

The present invention relates generally to improvements in portable seating devices and, more particularly, to an improvement in a combined seat and cane.

2. Description of the Related Art

In the related art, combined canes and seats are well known. Disabled people forced to use canes to aid in walking are faced with obstacles on a daily basis that most of us take for granted. Simple travel from place to place becomes a major undertaking that requires considerable effort. Fortunately, the public is becoming increasingly aware of the difficulties that these people face and are responding in a positive manner. For example, legislation such as the Americans with Disabilities Act imposes responsibilities upon the public sector to make provisions to accommodate the physically disabled so that they may gain access to, and take advantage of, the various goods and services available to others. Unfortunately, however, there are many aspects in which our society has failed to respond thus far in addressing this issue. Access for the disabled doesn't just mean being able to get inside the door, it means being able to do so with a relative amount of comfort. A prime example of this situation is that many times waiting in lines is involved. These lines can be found in grocery stores, banks, license bureaus, and the like where there are no seating areas provided in lines. Additionally, the wait may be from a few minutes to thirty minutes or more, which is extremely uncomfortable, if not impossible, for many disabled people. Accordingly, there is a need for a means by which disabled people can have access to seating areas while waiting in lines with greater ease and efficiency.

Prior art combined canes and seats attempt to fulfill this need by providing a collapsible seat connected to the main shaft body of the cane via a collapsible attachment means. To use, one simply folds the seat down into the horizontal position and seats themselves thereon. The bottom tip of cane rests on the ground and the user supports their weight thereon in this fashion. Examples of these type of cane and seat combinations are U.S. Pat. No. 4,684,090 issued to Skarland, and U.S. Pat. No. 731,291 issued to Dulin. However, the drawback of to these inventions is that one must constantly balance themselves on the seat as the entire weight of the user is transmitted to the ground solely through the tip of the cane. Another type of cane and seat combination, found in U.S. Pat. No. D 284,429 issued to Garde, appears to try to eliminate this problem by providing a collapsible seat and cane combination with a folding tubular structure that has a pair of legs for supporting the device when in the open position. However, such an arrangement proves to be bulky when carrying and doesn't look like a conventional cane.

The present invention eliminates this problem by providing a conventional cane with a collapsible leg and seat assembly that allows a disabled individual to quickly deploy when stationary such as waiting in a line. At the base of the cane there are a plurality of legs that fold out and lock in a tripod-based arrangement similar to that found on a music stand. The seat assembly is a plurality of four retracting rods connected together via a pair of cross-members that stow conveniently inside the hollow stem of the cane. A fabric seat covering also unfolds from within the hollow cane stem wherein said fabric covering is connected along two edges to said cross-members and suspended therebetween in a semi-taut manner. When collapsed the Cane Seat forms a thin, streamlined, and lightweight arrangement that functions as a cane in a conventional manner. As a result of using the Cane Seat, the individual may move around with relative ease, and always be guaranteed access to a seat whenever they find themselves waiting in a line.

A search of the prior art did not disclose any patents that read directly on the claims of the instant invention; however, the following references were considered related:

| U.S. Pat. No. | Inventor | Issue Date |
|---|---|---|
| 4,684,090 | Skarland | August 4, 1987 |
| 731,291 | Dulin | June 16, 1903 |
| D 284,429 | Garde | July 1, 1986 |
| 4,562,850 | Earley et al. | January 7, 1986 |
| 4,130,294 | Walker | December 19, 1978 |
| 4,062,372 | Slusher | December 13, 1977 |
| D 290,186 | Meunchen | June 9, 1987 |
| D 251,098 | Diedrich et al. | February 20, 1979 |
| 5,060,967 | Hulterstrum | October 29, 1991 |

SUMMARY OF THE INVENTION

It is therefore an object of the present invention to provide an improved Cane Seat.

It is a feature of the present invention to provide a guaranteed seat while waiting in a line.

It is another feature of the present invention to provide comfort during long waits.

It is yet another feature of the present invention to be quickly deployable and collapsible.

It is still yet another feature of the present invention to provide a quadrapod leg arrangement.

It is yet still another feature of the present invention to provide a padded seat.

It is another feature of the present invention to function as a conventional cane and a seat.

It is yet another feature of the present invention to provide a streamlined design.

It is still yet another feature of the present invention to be lightweight, strong and durable.

It is yet still another feature of the present invention to be manufactured from readily obtainable materials.

Briefly described according to the preferred embodiment of the present invention, a Cane Seat is provided comprised of a hollow tube with a handle pivotally connected at one end, a plurality of four seat support members removably inserted in the cavity of said end in a manner to be deployed as required for forming a seat framework. A sheet of fabric is suspendably supported between two cross-members linking the support members to form a surface for sitting. The opposite end of the tube has a plurality of four legs removably inserted in the hollow cavity of said end for deploying as required to provide a base structure to support the device upon a level surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| | |
|---|---|
| 10 | Cane Seat |
| 20 | Pivoting Handle |
| 21 | Hinge |
| 22 | Articulating Seat Rods |
| 22a | Aperature |
| 22c | Retaining Clip |
| 23 | Pin |
| 23a | Apertures |
| 24 | Seat Rod Cross Members |
| 24a | Pin |
| 25 | Channels |
| 26 | Upper Shaft |
| 26a | Cavity |
| 26b | Spline Section |
| 27 | Upper Seat Shaft Collar |
| 28 | Lower Seat Shaft Collar |
| 29 | Stop |
| 30 | Seat Cover |
| 30a | Seat Cover Hooks |
| 35 | Push Button Lock |
| 40 | Shaft |
| 41 | Telescoping Mid-Section |
| 42 | Retractable Seat Assembly |
| 44 | Base Assembly |
| 50 | Leg |
| 50a | Pin |
| 50b | Aperture |
| 51 | Lower Shaft |
| 51a | Hollow Cavity |
| 51b | Aperture |
| 52 | Upper Leg Shaft Collar |
| 53 | Lower Leg Shaft Collar |
| 54 | Channels |
| 55 | Spring Loaded Push Button |
| 56 | Tab Lock |
| 57 | Spline Section |
| 60 | Rubber Tip |
| 70 | Linking Cross Member |
| 75 | Sliding Lock |
| 80 | Tab Lock |
| 82 | Brace |

DESCRIPTION OF THE PREFERRED EMBODIMENTS

The best mode for carrying out the invention is presented in terms of its preferred embodiment, herein depicted within the following Figures.

DETAILED DESCRIPTION OF THE FIGURES

Figure 1:
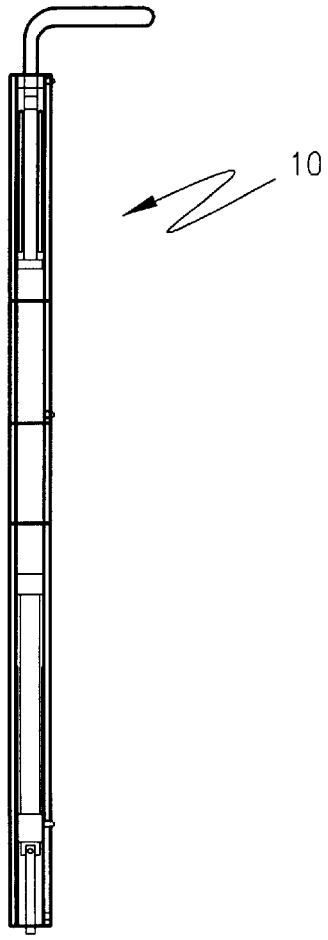
FIG. 1 is a front view of a Seat Cane in the fully retracted configuration according to the preferred embodiment of the present invention.

Referring now to FIG. 1, a front view of a Cane Seat 10 is shown in the fully closed configuration. In such a configuration, the Cane Seat 10 is an invaluable aid for those who have difficulties walking.

Figure 2:
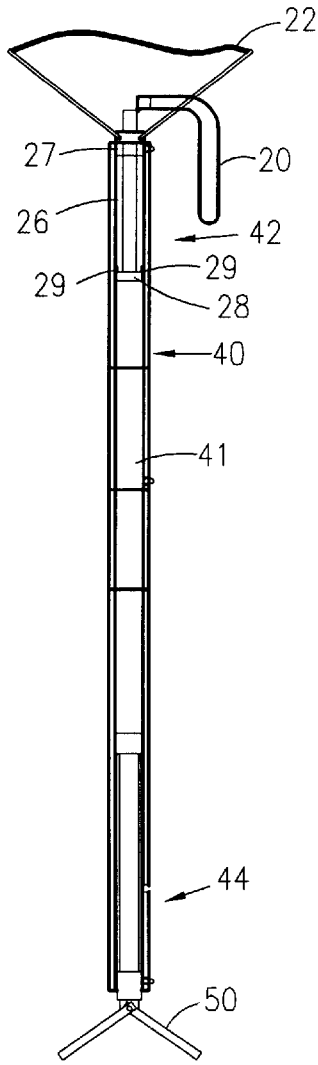
FIG. 2 is a front view of a Seat Cane in the fully opened position according to the preferred embodiment of the present invention.

Referring now to FIG. 2, a front view of a Cane Seat 10 is shown in the fully open configuration. In such a configuration, the Cane Seat 10 is an invaluable aid for those who may tire while walking and desire a temporary place to sit. The Cane Seat is comprised of a shaft 40 consisting of a hollow cylinder having an elongated longitudinal axis. Shaft 40 can be made out of any material that is lightweight, stiff and capable of being formed as heretofore described. Shaft 40 is approximately one inch in diameter and three feet in length along its elongated longitudinal axis. It should be noted that these dimensions are given only as suggestions and in no way should be construed to imply any limitation. Shaft 40 is divided into two equal sections at manufacture to allow a telescopic mid-section assembly 41 to be inserted into the hollow cavity on adjoining ends of the two shaft sections. It is envisioned that a simple spring loaded mechanism would allow one to unlock the telescopic mid-section assembly to allow the user to extend and retract the length of the Cane Seat 10 as desired. Shaft 40 has a top end and a bottom end. Located on the top of shaft 40 is a pivoting handle 20 attached via a hinge 21. Located just beneath pivoting handle 20 inside the hollow cavity of shaft 40 is a retractable seat assembly 42 shown in a retracted position within the top end of the shaft 40 described further hereinbelow. On the bottom end of shaft 40 is a base assembly 44 comprising a plurality of legs 50 for supporting the Cane Seat 10 in a vertical orientation on a horizontal surface.

Figure 3:
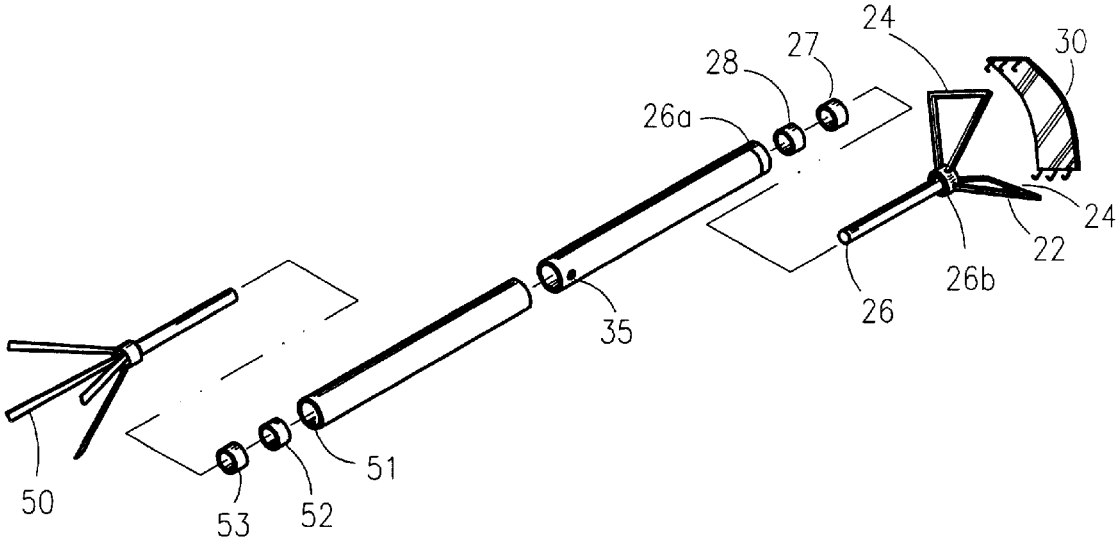
FIG. 3 is an exploded view of a Cane Seat according to the preferred embodiment of the present invention.

Referring now to FIG. 3, shown is an exploded view of a Cane Seat 10 according to the preferred embodiment of the present invention showing the detail of a plurality of four articulating seat rods 22 extending radially from a spline 26*b* formed on upper shaft 26 which is slidably inserted into the hollow cavitie 26*a* at the top end of shaft 40. Also shown is the detail of the insertion of lower shaft 51 into a hollow cavity 51*a* at the bottom end of shaft 40 and articulating legs 50 attached thereto.

Figure 4A:
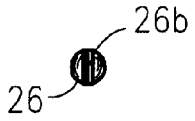
FIG. 4*a* is a top view of the upper shaft of a Cane Seat according to the preferred embodiment of the present invention.
Figure 4B:
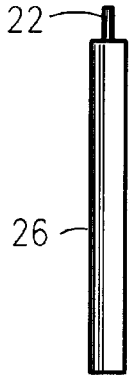
FIG. 4*b* is a side view of the upper shaft of a Cane Seat according to the preferred embodiment of the present invention.
Figure 4C:
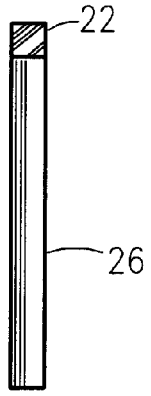
FIG. 4*c* is a front view of the upper shaft of a Cane Seat according to the preferred embodiment of the present invention.

Referring now to FIGS. 4*a*, 4*b* and 4*c*, shown in detail is upper shaft 26 constructed from a strong, lightweight metal and having an upper end, a lower end, an elongated longitudinal axis, and generally cylindrical in shape. Upper shaft 26 is fluted on two sides so that a spline section 26*b* with a linearly elongated rectangular cross section is formed along the elongated longitudinal axis of upper shaft 26. This spline section 26*b* of upper shaft 26 extends from the upper end of upper shaft 26 for a length just slightly longer than the length of articulating seat rods 22. The purpose of this will become clearer further in this description.

Figure 5A:
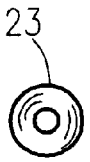
FIG. 5*a* is a top view of a flared pin of a Cane Seat according to the preferred embodiment of the present invention.
Figure 5B:
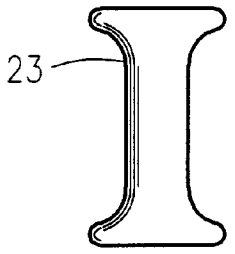
FIG. 5*b* is a front view of a flared pin of a Cane Seat according to the preferred embodiment of the present invention.
Figure 6:
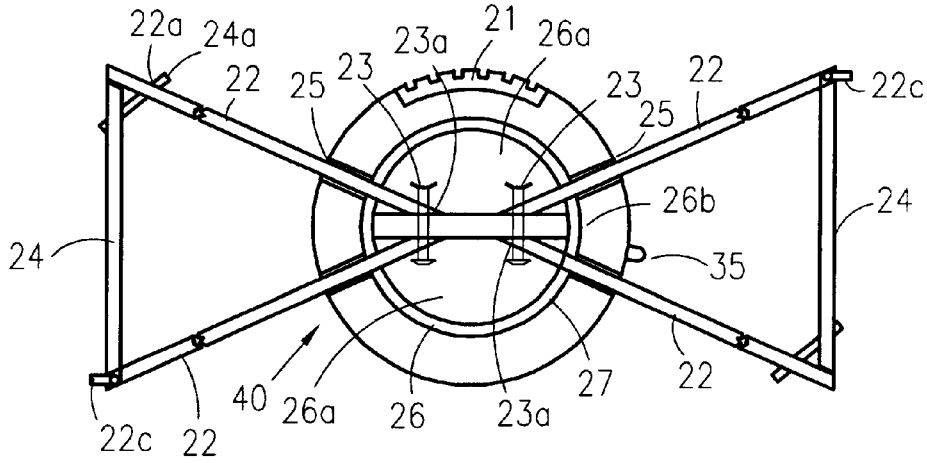
FIG. 6 is a top view of the of a Cane Seat in a fully opened configuration showing the detail of the seat rod assembly pivotally attached to the splined section of an upper shaft according to the preferred embodiment of the present invention.

Referring now to FIGS. 5*a* 5*b* and 6, the plurality of four articulating seat rods 22 are pivotally attached at the upper end of upper shaft 26 via a pair of flared pins 23 interference fitted in a pair of apertures 23*a* formed near the top of the spline section 26*b* of said upper shaft 26. Pins 23 may be ¼ roll pins or equivalent or be replaced entirely by bolts. Two of the plurality of four seat rods 22 are attached on one side of upper shaft 26 on a flat surface of the spline section 26*b*. The remaining two of the plurality of four seat rods 22 are located on the opposite side of the spline section 26*b* of upper shaft 26. Seat rods 22 are free to pivot about flared pins 23 so that when it is desired to place the seat rods 22 in the retracted configuration the seat rods 22 are free to pivot and be aligned parallel to the flat surface of the spline section 26*b*. Upper shaft 26 is then slidably fitted in the interior cavity 26*a* near the upper end of shaft 40. Located just beneath the flared pin 23/seat rod 22 joint is upper seat collar 27 permanently fitted around an external peripheral wall of upper shaft 26. The purpose of upper seat collar 27 is to align upper shaft 26 inside the hollow cavity 26*a* of shaft 40 as upper shaft 26 translates back and forth from the deployed and retracted configurations. Similarly, a lower seat collar 28 (shown in FIG. 2) is located at the lower end of upper shaft 26. This serves to keep upper shaft 26 aligned as upper shaft 26 slidably translates in an up and down fashion inside shaft 40 between said retracted and deployed configurations. A stop 29 (shown in FIG. 2) fitted on the interior cavity of said shaft 40 is provided to limit the distance upper shaft 26 can travel in the vertical direction and to prevent upper shaft 26 from completely exiting from the interior cavity of shaft 40. A spring loaded push bottom 35 locking mechanism is utilized to secure the seat rod 22/upper shaft 26 assembly in the stowed configuration within shaft 40.

A plurality of channels 25 cut into a sidewall of shaft 40 on its uppermost edge are provided to receive said seat rods 22 when in the fully deployed configuration. The channels 25 are spaced radially around the circumference of shaft 40 such that there is a forty-five degree separation between seat rods 22 that are on the same side of spline section 26*b*. Located on the sidewall on the upper end of shaft 40 and positioned radially between seat rods 22 on opposing sides of spline section 26*b* is a hinge 21 for hingedly attaching the pivoting handle 20.

Attached pivotally at the other end of one of the seat rods 22 in each of said pairs are seat rod cross members 24. Again, each seat rod cross member 24 is pivotally attached at one end via flared pin 24*a* interference fitted in an aperture 22*a* in said seat rod 22 and loosely fitted to allow one to manipulate seat rod said cross member 24 in such a fashion to attach an opposite thereof end to the opposite seat rod 22 on the same side of spline section 26*b*. The attachment can be one of several means but a retaining clip 22*c* utilizing a semi-interference fit arrangement is suggested. The exact same configuration with the two remaining seat rods 22 and linking cross member 24 is used on the other side of spline section 26*b*. Referring now to FIG. 3, a seat cover 30 is shown is fastened around one of the pair of seat rod cross members 24 by sewing or stapling on one edge of the seat cover 30. Sewn into an opposing edge of the seat cover 30 are small hooks 30*a* of sufficient radius that can grab and hold the opposing seat rod cross member 24. This effectively suspends seat cover 30 between said seat rod cross members 24. A lower surface of seat cover 30 rests upon the top edges of seat rods 22. The upper surface provides a level surface where one may rest upon in a sitting position. In the retracted configuration, said seat cover 30 is unhooked from the opposing seat rod cross member 24 and rolled up in such a fashion that it can be inserted into cavities 26*a* located in the upper end of shaft 40 next to seat rods 22 located on that side of said spline section 26*b*. Seat rods 22 are inserted into shaft 40 and stored in the cavity (marked as cavity 26*a*) between the flat surface of spline section 26*b* and the inner wall of shaft 40. Similarly, seat rods 22 and cross member 24 on the opposite side of said spline section 26*b* are retracted and inserted into cavity 26*a* now present in shaft 40 when upper shaft 26 is placed into the retracted configuration.

Figure 7:
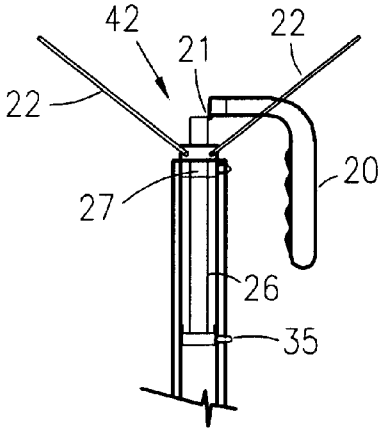
FIG. 7 is a cut away side view of the retracting seat assembly of a Cane Seat in the opened configuration showing the detail of how the functional elements of the retractable seat assembly are deployed within the main shaft body according to the preferred embodiment of the present invention.

Referring now to FIG. 7, the detail of the retractable seat assembly 42 is shown. Pivoting handle 20 is connected to the top of the sidewall of shaft 40 via a hinge 21. When deployed, handle 20 simply pivots out of the way. Seat rods 22 are extracted from within shaft 40 by pressing push button 35 and pulling upper shaft 26 from within the cavity of shaft 40. Upper seat collar 27 is permanently fixed around upper shaft 26 and located just beneath where seat rods 22 are pivotally fixed to upper shaft 26.

Figure 8:
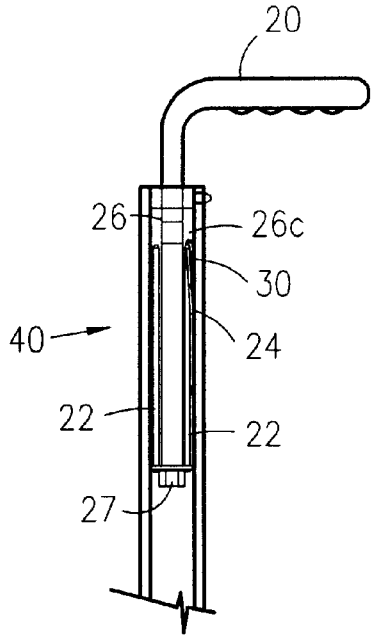
FIG. 8 is a cutaway side view of the retractable seat assembly/pivoting handle of a Cane Seat in the completely closed configuration showing the detail of the manner in which the functional elements of the retractable seat assembly are stowed within the main shaft body according to the preferred embodiment of the Present invention.

Referring now to FIG. 8, the detail of seat rods 22, cross members 24, and seat cover 30 is shown in the retracted configuration. Handle 20 is locked in the upright position to give a user a firm surface to grip onto and rest some of their body weight upon when walking. As previously described, seat rods 22, cross members 24, and seat cover 30 are stored ready for deployment in the cavity 26*a* formed in shaft 40 when upper shaft 26 is in the retracted position.

Figure 9:
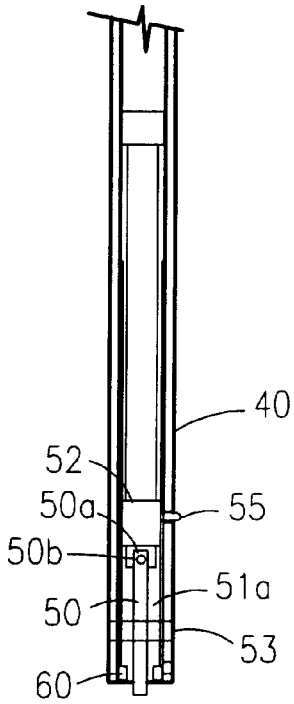
FIG. 9 is a cutaway front view of the bottom end of a Cane Seat showing the detail of the retracting leg assembly on one side of a splined section stowed within the main shaft body according to the preferred embodiment of the present invention.
Figure 10:
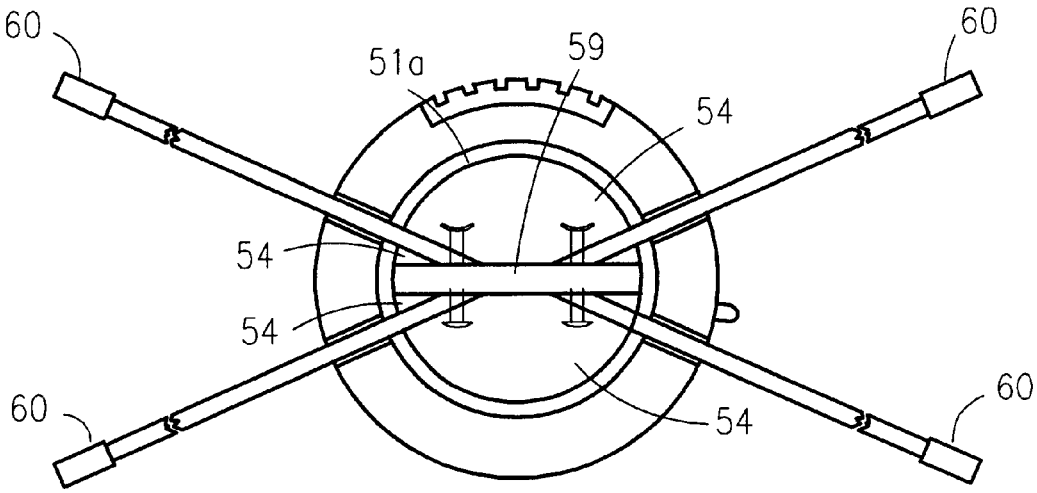
FIG. 10 is a bottom view of the bottom end of a Cane Seat in the completely opened configuration showing the detail of the manner in which the functional elements of the retractable quadraped leg assembly are deployed from within the main shaft body according to the preferred embodiment of the present invention.

Referring now to FIGS. 9 and 10, shown is a cutaway side view and bottom view respectively, of the bottom end of shaft 40 displaying the detail of a leg assembly of a Seat Cane 10 according to the preferred embodiment of the present invention. A plurality of four legs 50 are pivotally attached at the lower end of lower shaft 51 on a spline section 51*a* specifically formed therefor. Spline section 51*a* has a pair of parallel opposing surfaces. Legs 50 are pivotally attached via a pair of flared pins 50*a* and aperture 50*b* arrangement. Each flared pin 50*a* is interference in a corresponding aperture 50*b* specially formed therefor in the splined section 51*a* of shaft 51. One pair of legs 50 are provided on each side of said spline section 51*a*. A plurality of four channels 54 are provided spaced radially around the outer circumference of the bottom sidewall of the bottom end of shaft 40. Channels 50 are specially formed to receive legs 54 and provide support therefor. Like the channels 25 provided for seat rods 22, channels 54 are spaced forty five degrees from the associated channel on the same side on spline section 51*a*. A spring loaded push button 55 is provided to lock the entire assembly inside the hollow cavity in the bottom end of shaft 40 until such time as it is desired to deploy the legs 50. A rubber tip 60*b* is provided on the lower end of each of said legs 50 to provide a non-slip grip for the entire assembly when placed on a surface.

Figure 11:
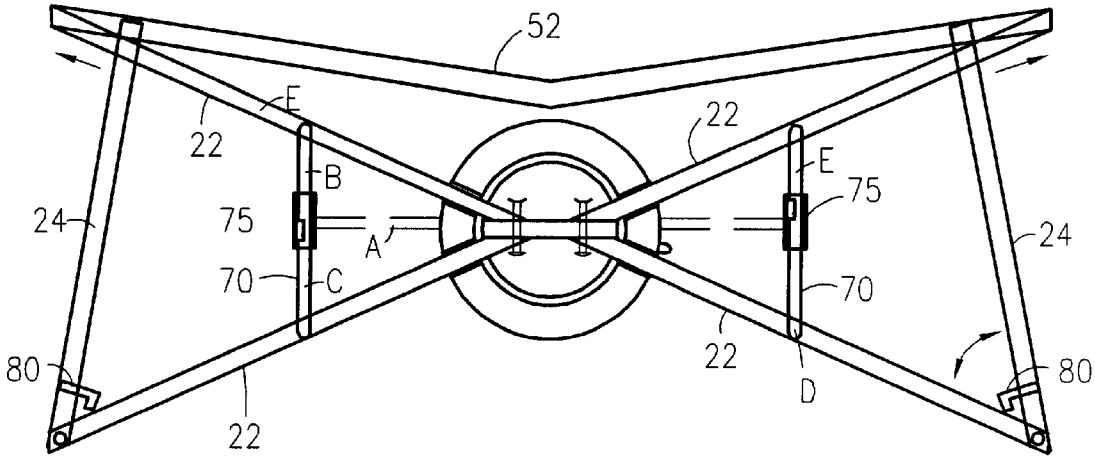
FIG. 11 is a top view of the seat rod and cross member assembly of a Cane Seat according to an alternate preferred embodiment of the present invention.
Figure 12:
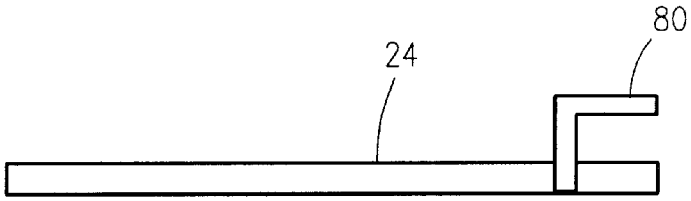
FIG. 12 is a side view a seat rod cross member with the alternate tab lock for the at rod assembly of a Cane Seat, according to an alternate preferred embodiment of the present invention.

Referring now to FIG. 11, shown is a top view of a Cane Seat 10 according to an alternate preferred embodiment of the present invention. An additional articulating linking cross member 70 has been added to each pair of seat rods 22 approximately midway between the outer cross members 24 and shaft 40. Each of a pair of sliding locks 75 is provided to keep each linking cross member 70 in place and stiffening the seat assembly 42. A tab lock 80 (shown in FIG. 12) which clamps articulating seat rods 22 and seat rod cross members 24 together may be used instead of retaining clip 22*c*. This same tab lock 80 may also be modified to lock all seat sections together should an additional articulating brace 82 be added (shown on the left side of FIG. 11) on one or both of the outer sides to provide additional support to the seat rod structure.

The foregoing description is included to illustrate the operation of the preferred embodiment and is not meant to limit the scope of the invention. The scope of the invention is to be limited only by the following claims.

What is claimed is:

1. A portable cane seat, comprised of:

a shaft, said shaft having a top end and a bottom end and comprising a hollow cylinder having an elongated longitudinal axis and being made from a lightweight and stiff material, said shaft is approximately one inch in diameter and three feet in length along its elongated longitudinal axis, and further wherein, said shaft is divided into two equal sections at manufacture to allow a telescopic mid-section assembly to be inserted into a hollow cavity on eahc adjoining end of said sections and a simple spring loaded mechanism allowing one to unlock the telescopic mid-section assembly to allow the user to extend and retract the length of said cane seat as desired;

a pivoting handle said pivoting handle being located on said top end of said shaft via a hinge;

a retractable seat assembly, said retractable seat assembly for providing a surface for sitting and normally stowed beneath said pivoting handle within a hollow cavity in said top end of said shaft, wherein said retractable seat assembly comprises an upper shaft, said upper shaft constructed from a strong, lightweight metal and having an upper end, a lower end, an elongated longitudinal axis, and a generally cylindrical shape, and wherein said upper shaft is fluted on two sides so that a spline section with a linearly elongated rectangular cross section is formed along the elongated longitudinal axis of said upper shaft, wherein said retractable seat assembly further comprises a plurality of four articulating seat rods, said plurality of four articulating seat rods extending radially from said spline and pivotally connected at one end to said spline via a flared pin interference fitted in an aperture formed near the top of said spline, wherein said retractable seat assembly further comprises a plurality of two articulating seat rod cross members, wherein each of said articulating seat rod cross members link together a pair of said articulating seat rods via a flared pin interference fitted in an aperture in said seat rod and a retaining clip, wherein said retractable seat assembly further comprises a fabric seat cover, said fabric seat cover being fastened around one of said seat rod cross members by sewing or stapling on one edge of said seat cover and sewn into an opposing edge of said seat cover are small hooks of sufficient radius to grab and hold said opposing seat rod cross member thereby suspending said seat cover between said seat rod cross members, wherein two of the plurality of four seat rods are attached on one side of said upper shaft and the remaining two of the plurality of four seat rods are located on an opposite side of said upper shaft;

a means for deploying and retracting said retractable seat assembly from within said hollow cavity in said top end of said shaft;

a base assembly, said base assembly located on said bottom end of said shaft for supporting said cane seat in a vertical orientation on a horizontal surface; and a means for deploying and retracting said base assembly from within a hollow cavity at the bottom end of said shaft.

2. The portable cane seat of claim 1, wherein a plurality of channels cut into the sidewall of said shaft on its uppermost edge are provided to receive said seat rods when in the fully deployed configuration, and said channels are spaced radially around the circumference of said shaft such that there is a forty-five degree separation between seat rods that are on the same side of said spline section.

3. The portable cane seat of claim 2, wherein said seat rods are free to pivot about said flared pins so that when user desires to place said seat rods in a retracted configuration, said seat rods are free to pivot and be aligned parallel to a flat surface of said spline section and said upper shaft is then slidably fitted in an interior hollow cavity near an upper end of said shaft.

4. The portable cane seat of claim 3, wherein located just beneath a flared pin/seat rod joint is an upper seat collar permanently fitted around an external peripheral wall of said upper shaft to align said upper shaft inside said hollow cavity of said shaft as said upper shaft translates back and forth from deployed and retracted configurations, and similarly, a lower seat collar is located at a lower end of said upper shaft to keep said upper shaft aligned as said upper shaft slidably translates in an up and down fashion inside said shaft between said retracted and deployed configurations.

5. The portable cane seat of claim 4, wherein a stop fitted on said interior hollow cavity of said shaft is provided to limit the distance said upper shaft can travel in a vertical direction and to prevent said upper shaft from completely exiting from said interior cavity of said shaft, and wherein, a spring loaded locking mechanism is utilized to secure a seat rod/upper shaft assembly in the stowed configuration within said shaft.

6. The portable cane seat of claim 5, wherein said seat cover in the retracted configuration is unhooked from said opposing seat rod cross member and rolled up in such a fashion that said seat cover can be inserted into said interior hollow cavity located in said upper end of said shaft next to said seat rods.

7. The portable cane seat of claim 6, wherein said seat rods are inserted into said shaft and stored in said interior hollow cavity between a flat surface of said spline section and an inner wall of said shaft, and similarly, said seat rods and said seat rod cross members on an opposite side of said spline section are retracted and inserted into said interior hollow cavity now present in said shaft when said upper shaft is placed into said retracted configuration.

8. The portable cane seat of claim 7, wherein said pins may be ¼ roll pins or equivalent or be replaced entirely by bolts.

9. The portable cane seat of claim 8, wherein said base assembly further comprises:

a plurality of four legs, said plurality of four legs pivotally attached at a lower end of a lower shaft on a spline section specifically formed for pivotally attaching said plurality of four legs and said spline section having a pair of parallel opposing surfaces;

a spring loaded push button, said spring loaded pushbutton provided to lock said assembly inside a hollow cavity in said bottom end of said shaft until such time as it is desired to deploy said legs;

a plurality of rubber tips, said plurality of rubber tips provided on a lower end of each of said legs to provide a non-slip grip for said base assembly when placed on a surface.

10. The portable cane seat of claim 9, wherein said legs are pivotally attached via a pair of flared pins and aperture arrangement, each of said flared pins being interference fitted in a corresponding aperture specially formed for receiving each of said flared pins in said spline section of said lower shaft.

11. The portable cane seat of claim 10, wherein a plurality of four channels are provided spaced radially around an outer circumference of a bottom sidewall of said bottom end of said shaft, said channels are specially formed to receive and provide support to said legs, said channels being spaced forty five degrees from an associated channel on a same side on said spline section.

* * * * *